US005199141A

United States Patent [19]

Trask et al.

[11] Patent Number: 5,199,141

[45] Date of Patent: * Apr. 6, 1993

[54] METHOD OF PRODUCING A NONWOVEN FIBROUS TEXTURED PANEL AND PANEL PRODUCED THEREBY

[75] Inventors: Elwood G. Trask; Robert R. Walters, both of Auburn, Me.

[73] Assignee: Gates Formed-Fibre Products, Inc., Auburn, Me.

[ * ] Notice: The portion of the term of this patent subsequent to Jan. 7, 2008 has been disclaimed.

[21] Appl. No.: 755,912

[22] Filed: Sep. 6, 1991

Related U.S. Application Data

[63] Continuation of Ser. No. 457,998, Jan. 10, 1990, Pat. No. 5,077,874.

[51] Int. Cl.[5] ..... D04H 5/06

[52] U.S. Cl. ..... 28/115; 28/109; 428/95

[58] Field of Search ..... 28/109, 115; 428/95, 428/284, 88, 288

[56] References Cited

U.S. PATENT DOCUMENTS

| | | | |
|---|---|---|---|
| 3,950,587 | 4/1976 | Colijn et al. | 28/109 X |
| 3,953,632 | 4/1976 | Robinson | 428/95 |
| 4,016,318 | 4/1977 | DiGioia et al. | 428/95 |
| 4,169,176 | 9/1979 | Hartmann et al. | 428/95 |
| 4,186,230 | 1/1980 | Sinclair et al. | 428/95 |
| 4,195,112 | 3/1980 | Sheard et al. | 428/288 |
| 4,199,634 | 4/1980 | Pole et al. | 428/95 |
| 4,205,113 | 5/1980 | Hermansson et al. | 428/286 |
| 4,230,755 | 10/1980 | Morris | 428/95 |
| 4,242,395 | 12/1980 | Zuckerman et al. | 428/96 |
| 4,258,094 | 3/1981 | Benedyk | 428/85 |
| 4,298,643 | 11/1981 | Miyagawa et al. | 428/85 |
| 4,315,965 | 2/1982 | Mason et al. | 428/198 |
| 4,320,167 | 3/1982 | Wishman | 428/288 |
| 4,324,752 | 4/1982 | Newton et al. | 264/25 |
| 4,342,813 | 8/1982 | Erickson | 428/296 |
| 4,359,132 | 11/1982 | Parker et al. | 181/169 |
| 4,390,582 | 6/1983 | Pickens, Jr. et al. | 28/109 X |
| 4,424,250 | 1/1984 | Adams et al. | 428/198 |
| 4,474,846 | 10/1984 | Doerer et al. | 428/284 |
| 4,568,581 | 2/1986 | Peoples, Jr. | 428/35 |
| 4,581,272 | 4/1986 | Walters et al. | 428/88 |
| 4,668,562 | 5/1987 | Street | 428/218 |
| 4,780,359 | 10/1988 | Trask et al. | 428/234 |

FOREIGN PATENT DOCUMENTS

| | | | |
|---|---|---|---|
| 2108115 | 9/1971 | Fed. Rep. of Germany | 28/115 |
| 6019509 | 6/1976 | Japan | 28/115 |

*Primary Examiner*—Andrew M. Falik
*Assistant Examiner*—John J. Calvert
*Attorney, Agent, or Firm*—J. L. Isaac; C. H. Castleman, Jr.; H. W. Oberg

[57] ABSTRACT

A nonwoven fibrous flexible material includes a needled web having a front outer surface and a non-glazed back surface disposed opposite thereof. The web includes interengaged first fibers and second thermoplastic fibers with the outer surface being substantially free of the second thermoplastic fibers. The web also has a plurality of weld joints between the second thermoplastic fibers and at least a portion of the first fibers proximate the back surface.

12 Claims, 4 Drawing Sheets

METHOD OF PRODUCING A NONWOVEN FIBROUS TEXTURED PANEL AND PANEL PRODUCED THEREBY

RELATED APPLICATION

This is a continuation application of U.S. patent application Ser. No. 07/457,998, filed Jan. 10, 1990, now U.S. Pat. No. 5,077,874 issued Jan. 7, 1992.

BACKGROUND OF THE INVENTION

In general, this invention relates to methods of producing nonwoven fibrous panels having a textured outer surface as well as fibrous panels produced by such methods. More particularly, this invention relates to a method for producing a nonwoven fibrous, flexible panel having a textured outer surface that includes needlepunching a needled web of at least interengaged first fibers and second thermoplastic fibers to produce the textured outer surface; and passing a fluid, at a temperature sufficient to melt at least a portion of the second thermoplastic fibers, through the web in a direction from the textured outer surface to produce a plurality of weld joints of the melted fibers; and it relates to nonwoven fibrous panels produced by such methods.

At present, nonwoven fabric interior linings and floor mats for motor vehicles made up of nonwoven fabrics having tufted surfaces to which a sintered thermoplastic, latex, latex compound, or flexible urethane resin layer must be applied to prevent fraying and to secure the tufts in place, are known such as those disclosed in: Wishman (U.S. Pat. No. 4,320,167); the FIG. 6 embodiment of Benedyk (U.S. Pat. No. 4,258,094); Walters et al. (U.S. Pat. No. 4,581,272); DiGioia et al. (U.S. Pat. No. 4,016,318); Hartmann et al. (U.S. Pat. No. 4,169.176); Sinclair et al. (U.S. Pat. No. 4,186,230); Zuckerman et al. (U.S. Pat. No. 4,242,395); Morris (U.S. Pat. No. 4,230,755); Robinson (U.S. Pat. No. 3,953,632); Pole et al. (U.S. Pat. No. 4,199,634); and FIG. 3 of Miyagawa et al. (U.S. Pat. No. 4,298,643). Applying such a layer to the nonwoven fabric substantially increases the cost to produce the interior linings and floor mats due to added costs of (1) using, storing, and properly applying the sintered thermoplastic, latex, latex compound, or urethane layer, and (2) the complex manufacturing machinery and added labor required to apply such a layer. Tufting is the drawing of yarns through a fabric, either woven or nonwoven, using a tufting machine. Tufting machines are generally multineedle sewing machines which push the yarns through a primary backing fabric that holds the yarns in place to form loops as the needles are withdrawn. Tufting requires that yarns separate from the woven or nonwoven backing fabric be used to form the tufts; thus, tufting of nonwoven fabrics to produce interior linings and floor mats adds costs to manufacture such items.

Related patents, each of which discloses a specifically-described nonwoven fabric heated in a particular manner, are as follows: Street (U.S. Pat. No. 4,668,562); Sheard et al. (U.S. Pat. No. 4,195,112); Benedyk (as above '094); Erickson (U.S. Pat. No. 4,342,813); Newton et al. (U.S. Pat. No. 4,324,752); Mason et al. (U.S. Pat. No. 4,315,965); and Trask et al. (U.S. Pat. No. 4,780,359). In particular, the nonwoven staple polymer fiber batt of Street (as above '562), also known as a high-loft nonwoven fabric, is simultaneously compressed substantially by vacuum and heated by pulling air at a temperature that will only make the polyester soft and tacky, through the batt. FIGS. 2 and 9 of Street ('562) illustrate the change in thickness and density of the batt before and after the disclosed Street process has been performed on the batt. Such substantial batt compression is undesirable in the fabrication of nonwoven fabric interior linings and floor mats, or the like, which generally have a decorative outer surface and must have sufficient strength and thickness to withstand frequent and harsh use.

It is a primary object of this invention to provide a method for producing a nonwoven fibrous, flexible panel retaining a "velour-like" textured outer surface, which is capable of withstanding frequent and harsh use without necessarily needing a backing layer of sintered thermoplastic, latex, latex compound, urethane, or the like. It is another object to produce a nonwoven fibrous panel by such a method that is less costly to make or has fewer different requisite components that known nonwoven fabric products of similar nature.

SUMMARY OF THE INVENTION

Briefly described, the invention includes a method for producing a nonwoven fibrous, flexible panel having a textured outer surface, comprising the steps of: providing a needled web having a back surface, the needled web comprised of interengaged first fibers and second thermoplastic fibers; needlepunching the web to produce the textured outer surface comprising at least a portion of the first fibers and the second thermoplastic fibers, the back surface located opposite the textured outer surface; and passing a fluid, at a temperature sufficient to melt at least a portion of the second thermoplastic fibers, through the web in a direction from the textured outer surface toward the back surface to produce a plurality weld joints, the textured outer surface thereafter being substantially free of the second thermoplastic fibers. Another characterization of the invention includes a method for producing a nonwoven fibrous, flexible panel having a textured outer surface, comprising the steps of: needlepunching a needled web to produce the textured outer surface comprising at least a portion of first fibers and second thermoplastic fibers, a back surface of the web located opposite the textured outer surface; and providing a pressure gradient across the web to move air, at a temperature sufficient to melt at least a portion of the second thermoplastic fibers producing a plurality of weld joints thereof, in a direction from the textured outer surface toward the back surface, the textured outer surface being substantially free of the weld joints. Also, the invention includes a nonwoven fibrous panel produced by either characterization of the method of the invention.

BRIEF DESCRIPTION OF THE DRAWINGS

The invention in its preferred embodiments will be more particularly described by reference to the accompanying drawings, in which like numerals designate like parts.

DESCRIPTION OF THE PREFERRED EMBODIMENTS

Figure 1:
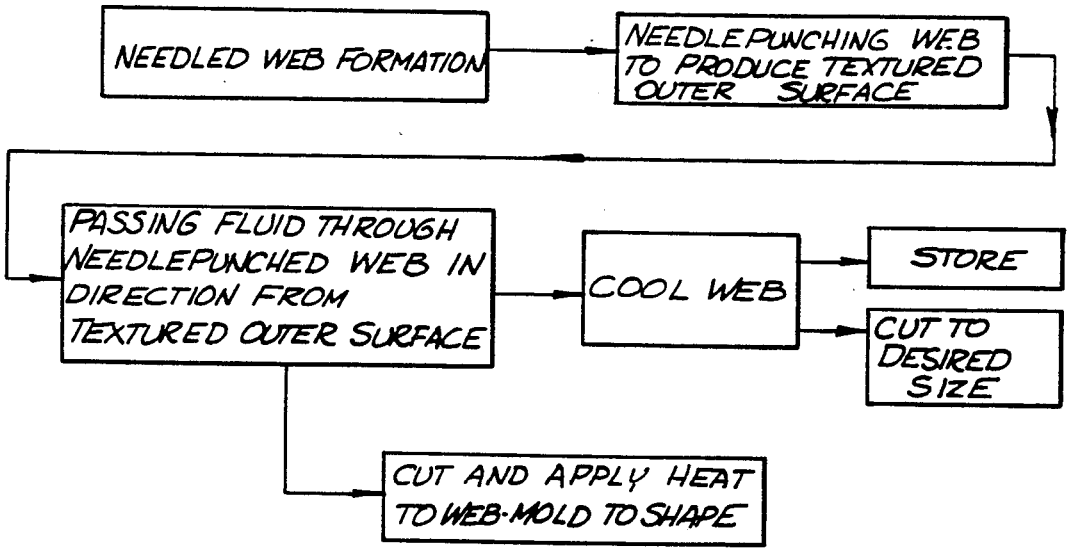
FIG. 1 is a block flow diagram of a preferred method of the present invention.

The first block in the flow diagram of FIG. 1 represents Needled Web Formation. A preferred nonwoven needled web of the invention is a blend of at least a first and second type of loose fiber interengaged and consolidated together to form a coherent nonwoven fabric, the second fiber type being a thermoplastic fiber. The interengaging and consolidating may be accomplished by an operation known in the art as needlepunching on a needle loom having needles that punch into and withdraw from the webbing at a desired number of strokes per minute; see Adams et al. (U.S. Pat. No. 4,424,250) for a more detailed description of needlepunching. Several different thermoplastic fibers are available for use as the second thermoplastic type of fiber in the preferred nonwoven needled web; these include, but are not limited to, polyethylene, polypropylene, polyester, nylon, polyphenylene sulfide, polyether sulfone, polyether-ether ketone, vinyon, and bicomponent thermoplastic fibers. Nylon fibers, as defined by the U.S. Federal Trade Commission, are made from a manufactured substance which is any long chain synthetic polyamide having recurring amide groups (—NH—CO—) as an integral part of the polymer chain; and include those nylon fibers derived from the polyamide condensation product of hexamethylenediamine and adipic acid (i.e. Nylon 6,6), as well as those derived from the polycondensation of epsilon caprolactam (i.e. Nylon 6). The Phillips Petroleum Company manufactures and sells a suitable polyphenylene sulfide under the trademark "Ryton". Vinyon fibers have been defined as fibers made from a manufactured substance which is any long chain synthetic polymer composed of at least 85% by weight of vinyl chloride units. An example of a usable bicomponent thermoplastic fiber is one made of a polypropylene core and a polyethylene sheath. Chisso Corporation of Japan manufactures a suitable bicomponent polyolefin fiber sold as "Chisso ES" fiber.

Figure 5:
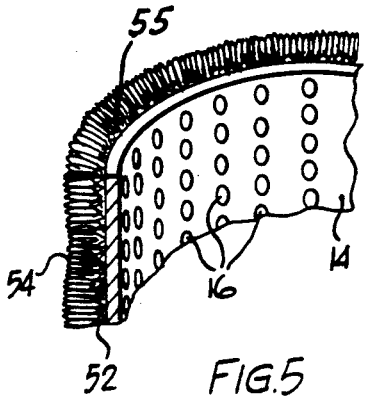
FIG. 5 is an enlarged, pictorial partial sectional view taken from FIG. 2 illustrating a preferred nonwoven fibrous panel of the invention.
Figure 5A:
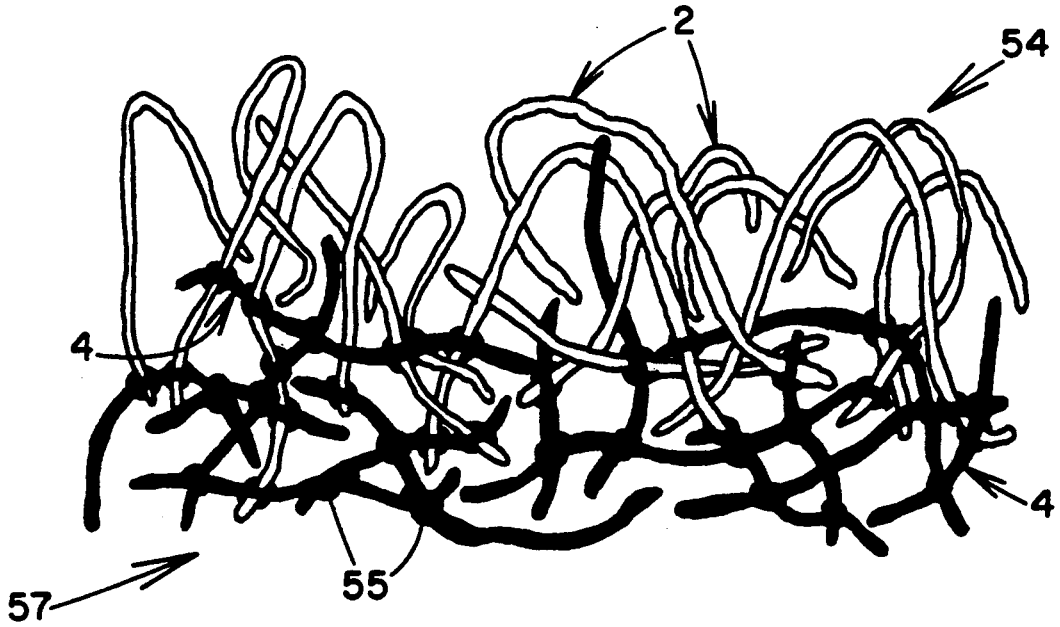
FIG. 5a is an enlarged view of a preferred nonwoven fibrous panel constructed in accordance with the invention and illustrating an expanded view of the weld joints thereof.

Referring further to FIG. 5a first type of fiber 2 in the preferred nonwoven needled web can be either (1) a non-thermoplastic fiber or (2) a thermoplastic fiber having a temperature melting point higher than that of the second thermoplastic type of fiber used in the needled web. Suitable non-thermoplastic fibers available for use as the first type of fiber 2 include, but are not limited to, wool, cotton, acrylic, polybenzimidazole, aramid, rayon or other cellulosic material, carbon, glass, and novoloid fibers. Due to their very high temperature stability, for purposes of the present invention polybenzimidazoles have been characterized as non-thermoplastics. Polybenzimidazoles are a class of linear polymers whose repeat unit contains a benzimidazole moiety. PBI is the acronym commonly used for the poly[2,2'-(m-phenylene)-5,5'-bibenzimidazole] (1) that is commercially available from Celanese Corp. (Charlotte, N.C.). Aramid fibers, as defined by the U.S. Federal Trade Commission, are made from a manufactured substance which is a long chain synthetic polyamide having at least 85% of its amide linkages (—NH—CO—) attached directly to two aromatic rings; and include those aramid fibers derived from poly(m-phenyleneisophthalamide) such as "Nomex" fibers (a registered trademark of E. I. du Pont de Nemours & Co.), as well as those derived from poly(p-phenyleneterephthalamide) such as "Kevlar" fibers (a registered trademark of E. I. du Pont de Nemours & Co.). Novoloid fibers have been defined as fibers made of a manufactured substance which contains at least 85% by weight of a cross-linked novolac. American Kynol, Inc., a division of the Japanese corporation Nippon Kynol, sells a suitable novoloid fiber under the registered trademark "Kynol".

If the first type of fibers 2 in the preferred nonwoven needled web are thermoplastic, the thermoplastic used must have a higher temperature melting point than the temperature melting point of the second thermoplastic type of fibers 4 used in the web so that the second thermoplastic type 4 can be melted without melting the first type. If the first type of fibers 2 are thermoplastic, any of the thermoplastics described above as being available for the second type of fibers 4 are also available for the first type of fibers 2 as long as the consideration stated immediately above is met. If desired, the preferred nonwoven needled web may have components in addition to the above-described first and second type of fibers 2 and 4, respectively.

A preferred nonwoven needled web which has only first and second type of fibers 2 and 4, respectively may have up to 20% of second thermoplastic type fibers 4 and correspondingly up to 80% of first type fibers 2. By way of example, a nonwoven needled web could have 13%-15% polyethylene second type fibers and, correspondingly, 87%-85% polypropylene first type fibers 2. Other example combinations include: low melt polyester copolymer second type fibers 4 with polyester first type fibers 2; polypropylene second type fibers 4 with polyester first type fibers 2; polyethylene second type fibers 4 with polyester first type fibers 2; and low melt polyester second type fibers 4 with polypropylene first type fibers 2. First and second type fiber combinations are in no way limited to these examples.

The second block in the flow diagram of FIG. 1 states "Needlepunching Web to Produce Textured Outer Surface". A process known as structured needlepunching (see apparatus 46 illustrated schematically in FIG. 2) may be used to produce a "velour-like" textured outer surface of the preferred nonwoven needled web. Such needlepunching may involve the use of fork-end shaped needles or barbed needles (known as crown needles which derive their name from the unique spacing of the barbs). The needles 47 in FIG. 2, will strike into and through the preferred nonwoven needled web and into a web supporting portion 48 in FIG. 2, to produce loops (if fork-end shaped needles are used) or raised, free ends (if crown needles are used) of the fibers in the web. Structured needlepunching will be described in more detail with FIG. 2. Velours are generally soft fabrics with a short thick pile having a velvet-like texture; they are often made of cotton, wool, a cotton warp in wool, silk, or mohair.

The third block in the diagram of FIG. 1 which says "Passing Fluid Through Needlepunched Web in Direction from Textured Outer Surface" will be discussed in conjunction with the descriptions of FIGS. 2-4. Suitable gases or liquids capable of being heated may be used as the fluid such as air or water. As suggested by the flow diagram, the heated web may then be, among other things, either (1) cooled and stored or cut into pieces/lengths, or (2) cut into pieces/lengths and thermally formed or molded by adding heat and pressure, into any three dimensional shape. If the lowest flow diagram block is performed, care must be taken not to soften, melt, and/or crush the loops, raised free ends, or the like, of fibers if it is desired that the product keep its velour-like textured outer surface.

Nonwoven fibrous panels produced according to the method of the invention may be used for vehicle trunk or passenger compartment linings, seat backs, kick panels, seating, as well as package/storage shelving, or for any use requiring a dimensionally stable fabric. Such nonwoven fibrous panels will have a minimum amount of fiber pullout wear.

Figure 2:
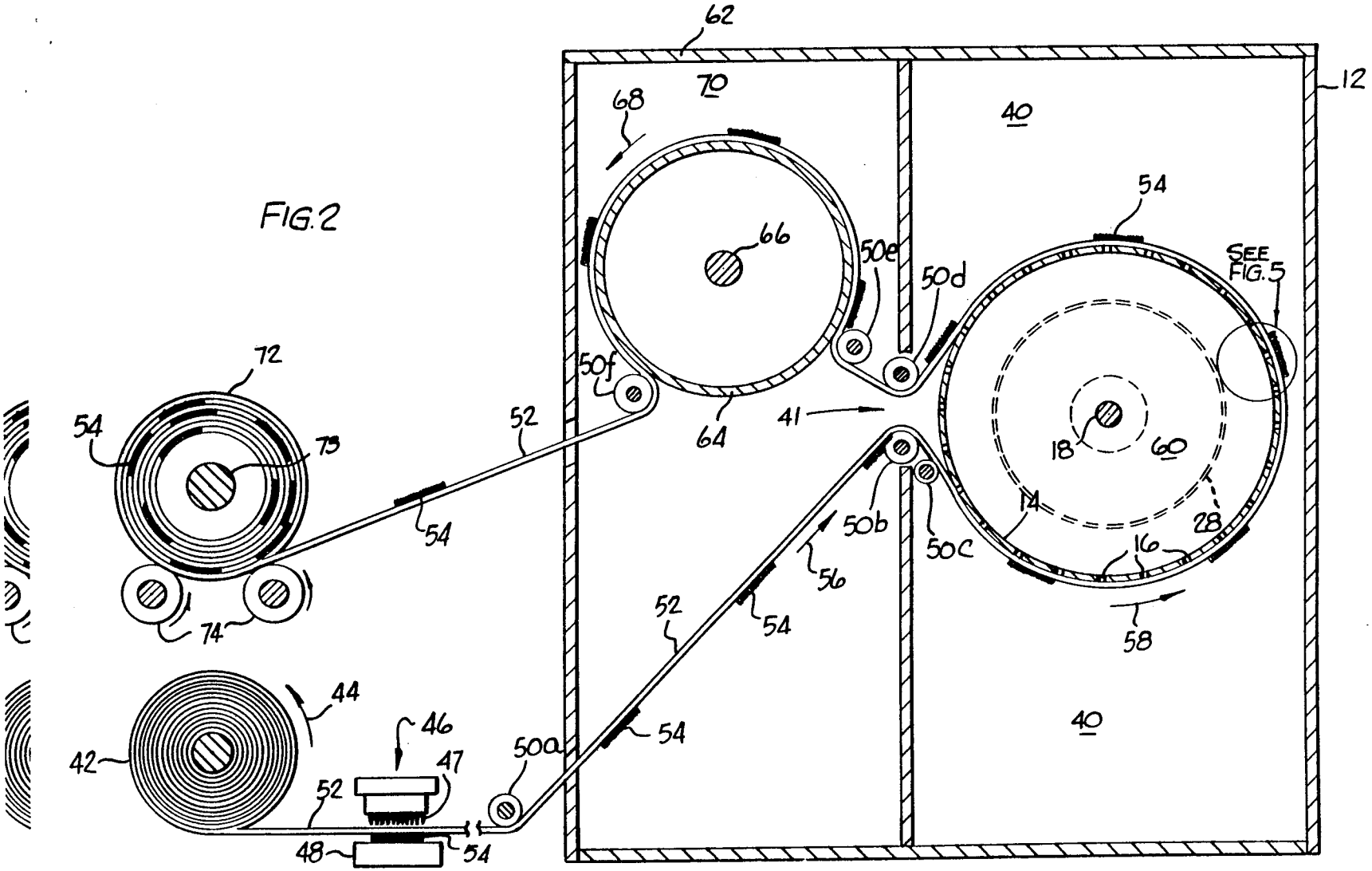
FIG. 2 is a schematic drawing of an apparatus capable of performing a preferred method of the present invention, particularly illustrating material flow.

FIG. 2 illustrates roll 42 of a preferred nonwoven needled web 52 being unwound in direction 44. Needled web 52 is passed through needlepunching apparatus 46 to produce a textured outer surface shown as loops 54. Both first and second type fibers of preferred nonwoven needled web 52, as well as any other fiber components interengaged uniformly therein, will become loops, raised free ends, or the like, of textured outer surface 54. The proportions of first and second type fibers in a preferred textured outer surface will be generally the same as their proportions in the needled web (the enlarged partial sectional of FIG. 5 illustrates the web 52 and its outer surface 54 in more detail). Needles 47 may be of various configurations to produce various velour-like outer surfaces—for simplicity only loops 54 are shown. Examples of acceptable needlepunching apparatuses 47 are: fork-end shaped needle Structuring Machines NL 11/S and NL 11/SM supplied by Fehrer AG of Austria; and crown needle Di-Lour and NL 21RV (Random Velour) looms manufactured by, respectively, Dilo, Inc. and Fehrer AG. Since it is likely that the speed at which web 52 is pulled through needlepunching apparatus 46 will be different than the speed of web 52 during the remaining illustrated process, there is shown a break point of web 52. This break indicates the point at which the web with its textured outer surface could be rolled for storage so that it can later be introduced into the remaining illustrated process at any convenient time.

Guide rollers 50*a-f* are used to guide the needled web 52 with textured outer surface 54 through the apparatus of FIG. 2 in the direction shown at 56, 58, 68. Web 52 enters fluid recirculation chamber 40, defined by heat chamber housing 12, through opening 41 where it is guided onto heat drum 14 by guide roller 50c. Heat drum 14 has apertures 16 located throughout as better seen in FIG. 1, and rotates in direction 58 around shaft 18. Textured outer surface 54 rides over heat drum 14 facing outwardly so that it will not be crushed or have its velour-like texture and appearance destroyed. Fan means 28 shown in dashed lines representing a squirrel cage type fan behind heat drum 14, can be positioned as illustrated. Fan means 29 (described in more detail with FIG. 4) will pull the fluid used to melt the second thermoplastic type fibers, through web 52 and apertures 16 into drum chamber 60. By pulling such fluid, heated to a temperature that will melt at least a portion of the second thermoplastic type fibers to produce weld joints 55, thereof, in a direction from recirculation chamber 40 into drum chamber 60, liquefied second thermoplastic type fibers will be pulled away from the textured outer surface 54. Upon rehardening of the small liquefied thermoplastic clumps 55 created, the textured outer surface should remain generally velour-like in texture and appearance while the back surface will lock the fibers without having a glazed-like or glossed over surface. In operation, fan means 29 will effectively create a pressure gradient across web 52 resulting in the movement of the fluid found in recirculation chamber 40 in a direction from the recirculation chamber 40 into drum chamber 60. Please see FIG. 4 to better understand the fluid circulation through chambers 40 and 60.

Preferably, a needled web 52 of only first and second type fibers is made of up to 20% second thermoplastic type fibers interengaged and consolidated together, as mentioned above. Thus, after at least a portion of second thermoplastic type fibers are heated to their melt temperature, a preferable nonwoven panel produced that has at least a majority, if not all, of its first type fibers left in tact will remain mostly fibrous. Furthermore, since approximately the same proportion (i.e. up to 20%) of second thermoplastic type fibers will be found in a preferred textured outer surface, as mentioned above, a preferable nonwoven panel produced according to the method described in the above paragraph, will have, after processing, a textured outer surface substantially free of second thermoplastic type fibers. It can be appreciated that weld joints 55 produced of second thermoplastic type fibers according to the method described in the above paragraph, will generally be concentrated away from the textured outer surface in a preferred nonwoven panel, leaving the textured outer surface velour-like in texture and appearance. Once the second thermoplastic type fibers have been melted, it is believed gravity may play some role in the final location of weld joints at very low fluid flow rates through web 52.

Guide roller 50*d* preferably has a tension sufficient to pull web 52 from heat drum 14, yet not crush textured outer surface 54. Guide roller 50*e* guides web 52 onto cool drum 64 which rotates around shaft 66 in direction 68 within cooling chamber 70, defined by housing 62. Guide roller 50*f* guides web off cooling drum 64. Surface winding rollers 74, driven in the direction indicated, wind web 52 around spool 73 or other suitable device into roll 72 for storage. Although not shown, the nonwoven panel(s) may be cut and thermally formed prior to preparing the product for storage. Note that heat chamber housing 12, cooling chamber housing 62, heat drum 14, and cooling drum 64 can be made of a metal, metal alloy, or other suitable material having sufficient strength and heat resistance.

Figure 3:
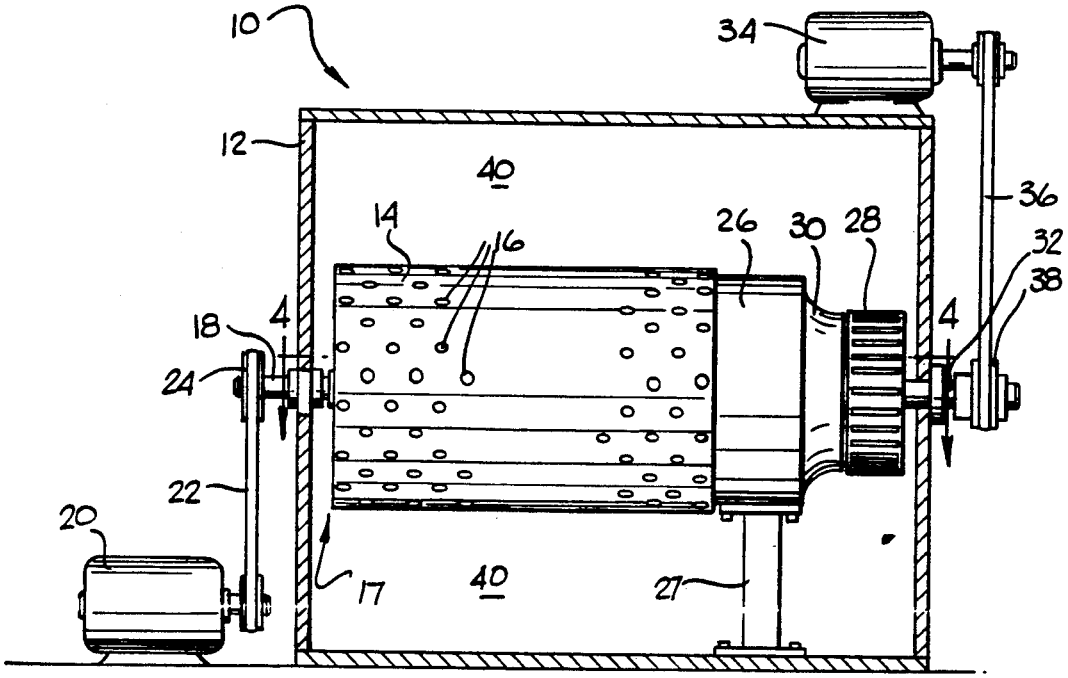
FIG. 3 is an end elevational view of an apparatus capable of performing a preferred method of the present invention.

Apparatus 10 of FIG. 3 includes a heat drum 14 with apertures 16 and enclosed at end 17 by a circular plate (shown at 15 in FIG. 4), capable of being rotated by shaft 18. Heat drum 14 may be driven in a conventional manner by means of an electric motor 20 connected by suitable drive belting 22 to a drive pulley 24. To simplify the diagram, needled web 52 and its textured outer surface 54 have been left out of FIG. 3. Fluid recirculation chamber 40, defined by heat chamber housing 12, is shown to contain the following: heat drum 14; burner housing 26 suitably mounted on base 27; fan means 28; as well as flared conduit 30. Shaft 32 for fan means 28 is driven independently from heat drum shaft 18 and may be driven in a conventional manner by electric motor 34 connected by suitable drive belting 36 to a drive pulley 38. Although fan means 28 is illustrated as a squirrel cage fan, any suitable fan configuration may be used to recirculate fluid through recirculation chamber 40 at a prescribed flow rate. A suitable burner (not shown) for heating a suitable recirculating fluid such as air, is a liquid propane Eclipse burner having a rating of 2 million BTUs. To operate properly, liquid propane burners such as the Eclipse burner generally need an intake of fresh air from outside the recirculation chamber 40. A burner fresh air intake is not illustrated in FIG. 3.

Figure 4:
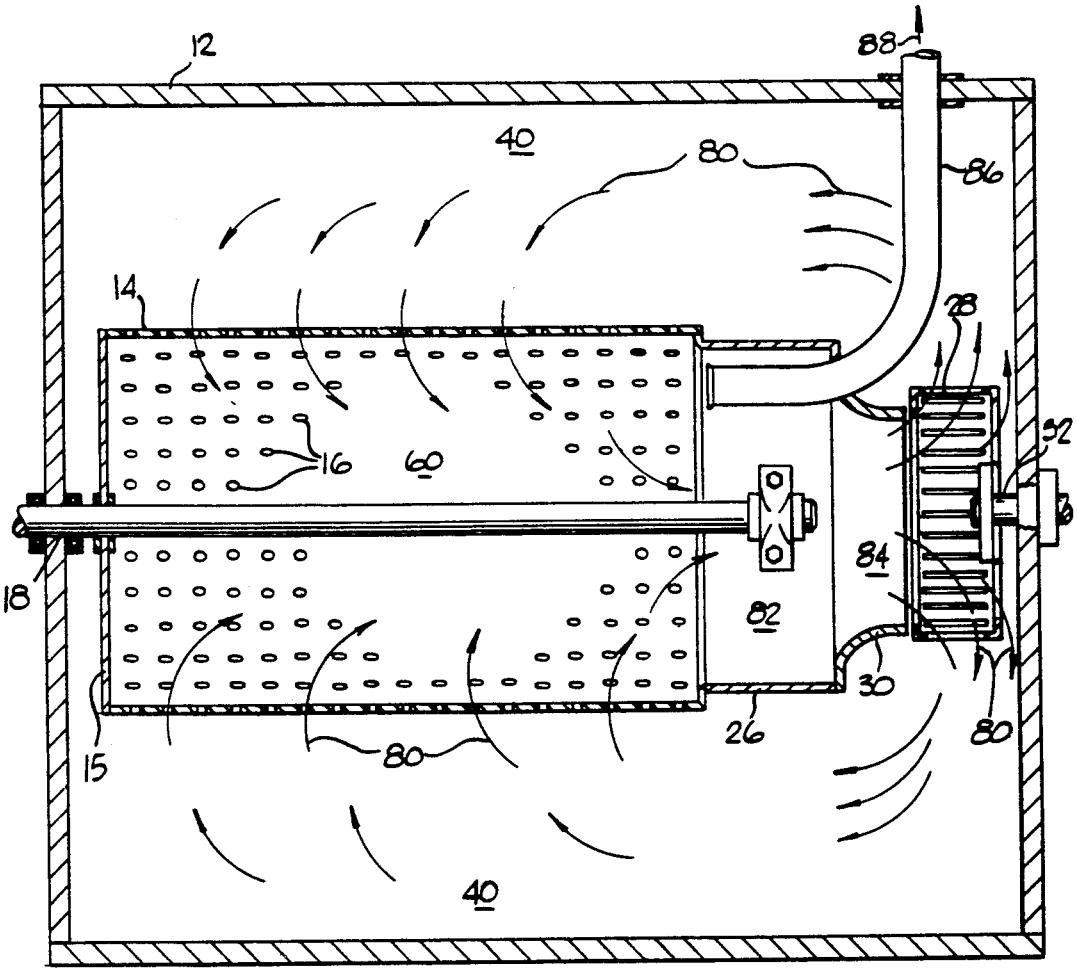
FIG. 4 is an enlarged, partial sectional view taken along 4—4 of FIG. 3 particularly illustrating the direction of fluid flow through fluid recirculation chamber 40 of the FIG. 3 apparatus.

The partial sectional in FIG. 4 illustrates the direction 80 of fluid flow through fluid recirculation chamber 40: in operation, fan means 28 draws the fluid such as air through apertures 16 into drum chamber 60 then through burner housing chamber 82 (burner not shown) to be heated and, finally, through flared conduit chamber 84. If fan means 28 takes some other configuration than that shown, such as a blade fan housed by suitable housing, the fan would exhaust the fluid out of its housing into the recirculation chamber 40 to be reused. Web 52, absent in FIG. 4, will be guided onto heat drum 14 with its textured outer surface 54 facing outwardly so that the heated fluid passes through the web in a direction from the textured outer surface toward the heat drum 14. Shaft 18 extends the length of heat drum 14 and is supported at each end by suitable means. Also shown in FIG. 4 is a fume exhaust pipe 86 through which, by suitable exhaust fan (not shown), any fumes given off by the melting of second thermoplastic type fibers will be discharged along direction 88.

Figure 6:
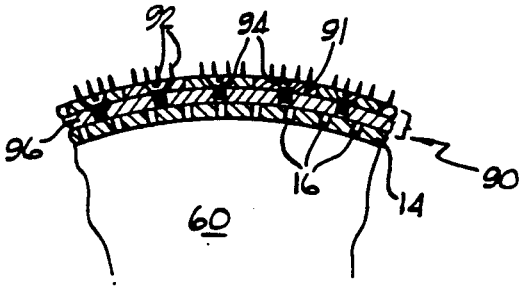
FIG. 6 is an enlarged, partial sectional view of the heat drum of FIG. 2 illustrating pin ring 90 secured around the circumference of heat drum 14.

FIG. 6 illustrates pin ring 90 made up of metal sections 91 having pins 92 therethrough, fastened by suitable means 94 to metal belting 96. A minimum of two pin rings 90 strapped around heat drum 14 at a width slightly less than the width of a preferred needled web 52 (yet unheated), may serve as a means of minimizing shrinkage of web 52 during heating by the recirculating fluid by spearing and holding the edges of web 52 to the heat drum.

EXAMPLE 1

By way of example, a nonwoven needled web was prepared of 13% 6 denier undyed natural polyethylene fiber and 87% 18 denier solution dyed polypropylene fiber was blended by interengaging and consolidating with a needlepunching machine, the loose fibers of approximately 2.5"–3.5" in length to form a generally uniform needled web. The polyethylene has a temperature melting point of 230°–250° F. and the polypropylene has a temperature melting point of 320°–350° F. The needled web was then needlepunched with fork-end shaped needles to produce an outer surface of loops of both polyethylene and polypropylene fibers. The web with its looped outer surface was then guided onto a heat drum of approximately 70" in diameter at a rate of approximately 20–30 feet per minute. The heat drum was driven by an electric motor. An Eclipse burner heated air to a temperature of approximately 265° F. to melt at least a portion of the polyethylene fibers in the web. A fan having a diameter of approximately 4 feet capable of providing a flow rate of 30–300 cfm/ft$^2$ (cubic feet per minute per square foot of web) was used to draw heated air through the fluid recirculation chamber at a flow rate of approximately 90 cfm/ft$^2$ (cubic feet per minute per square foot of web). Cooling chamber 70 was held at approximately room temperature (70° F.).

While certain representative embodiments and details have been shown for the purpose of illustrating the invention, it will be apparent to those skilled in the art that various modifications may be made to the invention without departing from the spirit or scope of the invention.

What is claimed is:

1. A nonwoven fibrous, flexible material comprising a needled web having a front outer surface and a non-glazed back surface disposed opposite thereof and including interengaged first fibers and second thermoplastic fibers, said outer surface being substantially free of said second thermoplastic fibers and said web having a plurality of weld joints between said second thermoplastic fibers and at least a portion of said first fibers proximate said back surface.

2. The nonwoven material as claimed in claim 1, wherein said back surface is substantially free of glazed second thermoplastic fibers.

3. The nonwoven material of claim 1, wherein said first fibers comprise at least one type of non-thermoplastic fibers selected from the group consisting of fibers of wool, cotton, acrylics, polybenzimidazoles, aramids, rayon, carbon, glass, and novoloid.

4. The nonwoven material of claim 1, wherein said first fibers comprise first thermoplastic fibers having a higher temperature melting point than that of said second thermoplastic fibers.

5. The nonwoven material of claim 4, wherein said second thermoplastic fibers comprise at least one type of thermoplastic fiber selected from the group consisting of fibers of polyethylene, polypropylene, polyester, nylons, polyphenylene sulfides, polyether sulfones, polyether-ether ketones, vinyon, and bicomponent thermoplastic fibers.

6. The nonwoven material of claim 4, wherein the outer surface is textured and comprises loops of said first and second thermoplastic fibers.

7. The nonwoven material of claim 4 wherein the outer surface is textured and comprises raised, free ends of said first and second thermoplastic fibers.

8. The nonwoven material as claimed in claim 1, wherein said weld joints comprise softened and rehardened second thermoplastic fibers to provide a concentration of said weld joints toward the back surface of said web.

9. The nonwoven material as claimed in claim 8, wherein said weld joints comprise completely melted and rehardened second thermoplastic fibers.

10. The nonwoven material as claimed in claim 8, wherein said weld joints comprise second thermoplastic fibers resulting from flow of softened second thermoplastic fibers flow toward said back surface prior to rehardening to concentrate said weld joints toward said back surface and to increase the interengagement between said rehardened second thermoplastic fibers and said first fibers.

11. The nonwoven material as claimed in claim 1, wherein said material is in the form of a panel.

12. A nonwoven fibrous, flexible panel comprising a needled web having a front textured outer surface and a non-glassed back surface disposed opposite thereof, said web having interengaged first fibers and second fibers, said second fiber having a melting point lower than said first fibers, said textured outer surface being substantially free of said second low melt fibers, said web further having a plurality of weld joints created between softened and rehardened second low melt fibers and at least a portion of said first fibers, said weld joints being concentrated toward said back surface with said back surface being substantially free of glazing.

* * * * *

UNITED STATES PATENT AND TRADEMARK OFFICE

CERTIFICATE OF CORRECTION

PATENT NO. : 5,199,141

DATED : April 6, 1993

INVENTOR(S) : Elwood G. Trask, Robert R. Walters

It is certified that error appears in the above-identified patent and that said Letters Patent is hereby corrected as shown below:

Column 8, line 50 (claim 10, line 4 thereof)

Delete "flow"

Signed and Sealed this

Eleventh Day of November, 1997

*Attest:*

*Attesting Officer*

BRUCE LEHMAN

*Commissioner of Patents and Trademarks*